US010351302B2

(12) United States Patent
Choltco-Devlin et al.

(10) Patent No.: US 10,351,302 B2
(45) Date of Patent: Jul. 16, 2019

(54) BEVERAGE CONTAINER WITH HANDLE

(71) Applicant: Pacific Market International, LLC, Seattle, WA (US)

(72) Inventors: Evan Michael Choltco-Devlin, Ellensburg, WA (US); Michael Carl Beckman, Ellensburg, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 15/170,796

(22) Filed: Jun. 1, 2016

(65) Prior Publication Data

US 2017/0349331 A1 Dec. 7, 2017

(51) Int. Cl.
*B65D 25/28* (2006.01)
*B65D 23/10* (2006.01)

(52) U.S. Cl.
CPC ..... *B65D 25/2817* (2013.01); *B65D 23/106* (2013.01)

(58) Field of Classification Search
CPC ..... B65D 25/2817; B65D 23/106; B65D 25/2811; B65D 25/2805; B65D 28/2802
USPC ..... 220/759, 592.17, 592.16
See application file for complete search history.

(56) References Cited

U.S. PATENT DOCUMENTS 3,191,819 A * 6/1965 SMith ..... A47J 45/077 16/422
5,413,231 A * 5/1995 Carroll ..... B65D 23/106 215/396
2014/0231442 A1* 8/2014 Hill ..... A47G 19/2266 220/740
2015/0041480 A1* 2/2015 Ramsey ..... A47G 23/0266 220/758

* cited by examiner

*Primary Examiner* — Stephen J Castellano
(74) *Attorney, Agent, or Firm* — Davis Wright Tremaine LLP; George C. Rondeau, Jr.

(57) ABSTRACT

A beverage container is provided having a container main body and a handle portion attached thereto. The container main body has an upper portion with an aperture, a lower sidewall extending downwardly from the aperture, and an upper sidewall having a substantially cylindrical shape extending upwardly from the upper portion. The handle portion includes a grip portion, an attachment collar disposed on an upper handle portion, and a lower handle portion fastened to the container main body by a fastening member. The attachment collar may have an annular or curved shape that snugly fits around the upper sidewall of the container main body to attach the upper handle portion to the container main body.

28 Claims, 4 Drawing Sheets

BEVERAGE CONTAINER WITH HANDLE

FIELD OF INVENTION

The present invention relates to beverage containers having a handle.

BACKGROUND

Some beverage containers have a handle attached to a beverage container main body for carrying the beverage container. The handle is typically attached to the beverage container main body by an upper connector portion and a lower connector portion extending respectively from the top and a bottom of the handle toward the beverage container main body. Each of the upper connector portion and the lower connector portion are fastened directly to a side of the beverage container main body using a fastener, such as a screw or bolt.

DETAILED DESCRIPTION

Figure 1:
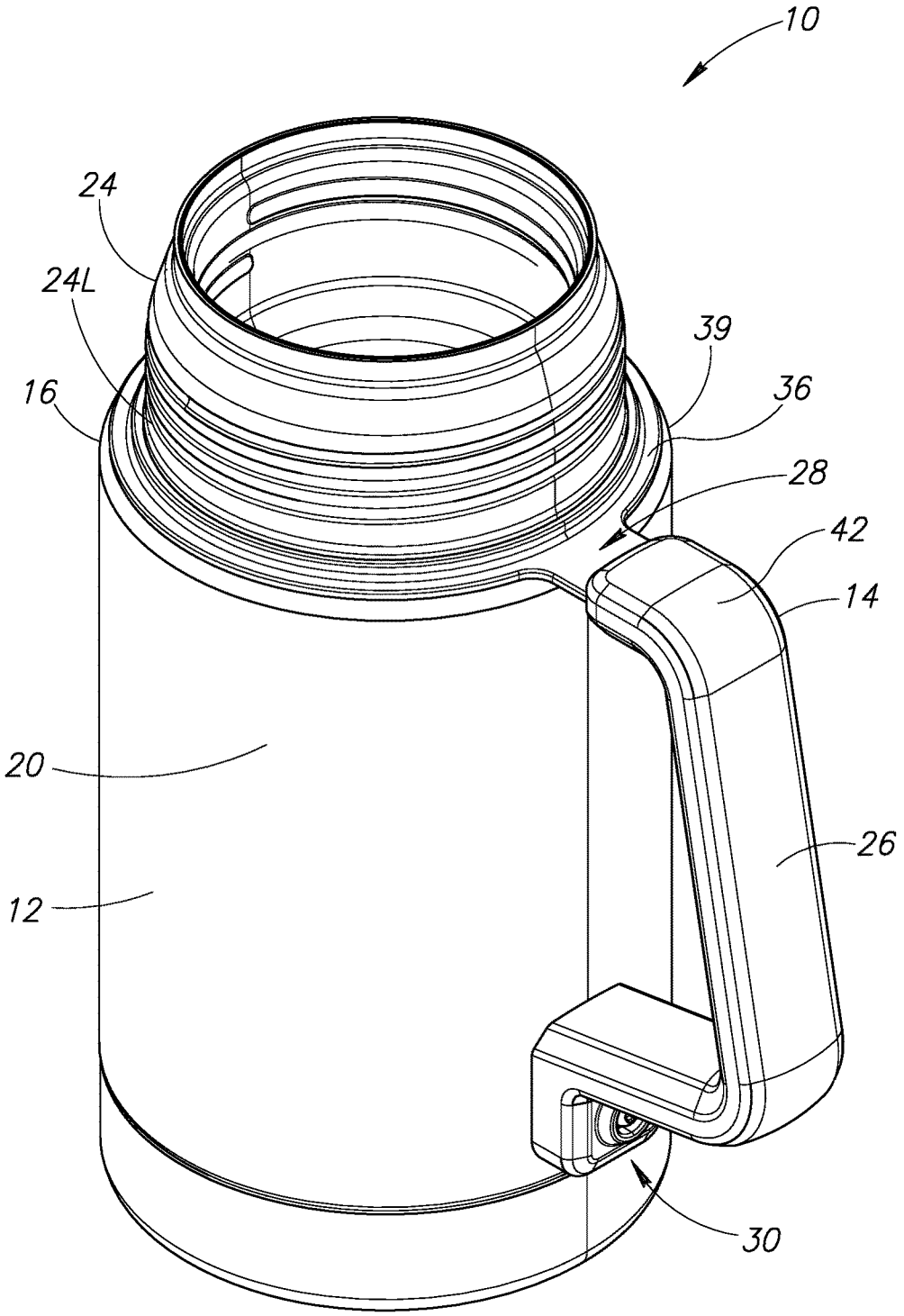
FIG. 1 illustrates a top perspective view of a beverage container according to a first embodiment.
Figure 2:
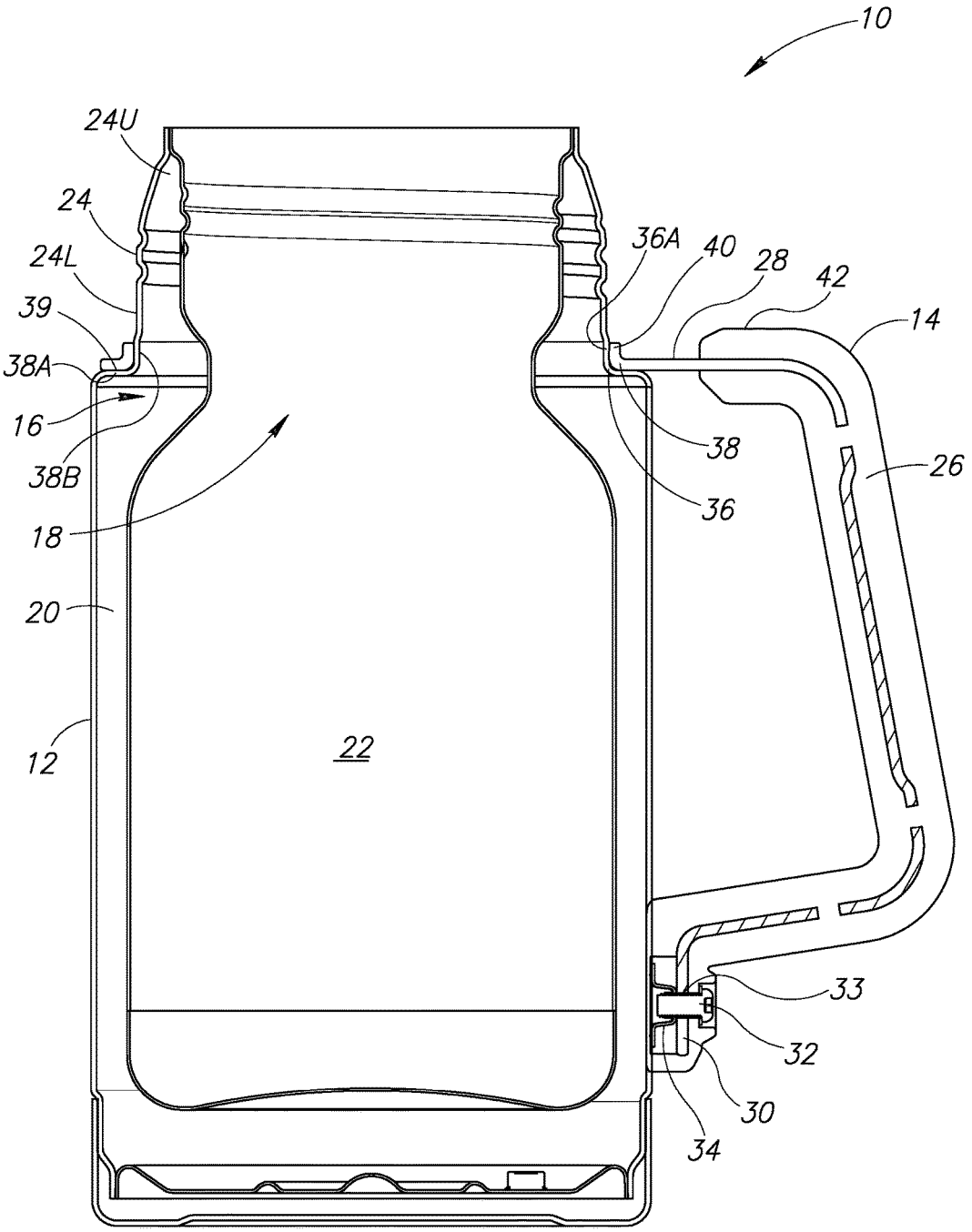
FIG. 2 illustrates a cross-sectional side view of the beverage container of FIG. 1.

A beverage container 10 according to a first embodiment is shown in FIG. 1. The beverage container 10 includes a substantially cylindrical container main body 12 and a handle portion 14 fixedly attached to the container main body. The container main body 12 has an upper portion 16 with an aperture 18, and a lower sidewall 20 extending downwardly from the aperture 18 and defining a beverage cavity 22, as shown in FIG. 2. An upper sidewall 24 of the beverage container 10 has a substantially cylindrical shape extend upwardly from the upper portion 16. The upper sidewall 24 may have a smaller diameter than the container main body 12.

The handle portion 14 has an elongated grip 26 for holding and carrying the beverage container 10. A handle upper portion 28 laterally extends from and connects an upper end portion of the grip 26 to the container main body 12. A handle lower portion 30 of the grip 26 is directly attached to the lower sidewall 20 by a fastening member 32. The fastening member 32 of the present embodiment is a threaded bolt or screw that extends through an aperture 33 on the handle lower portion 30 and engages with a receptacle 34 on the lower sidewall 20; however, other methods of attachment are contemplated.

Figure 3:
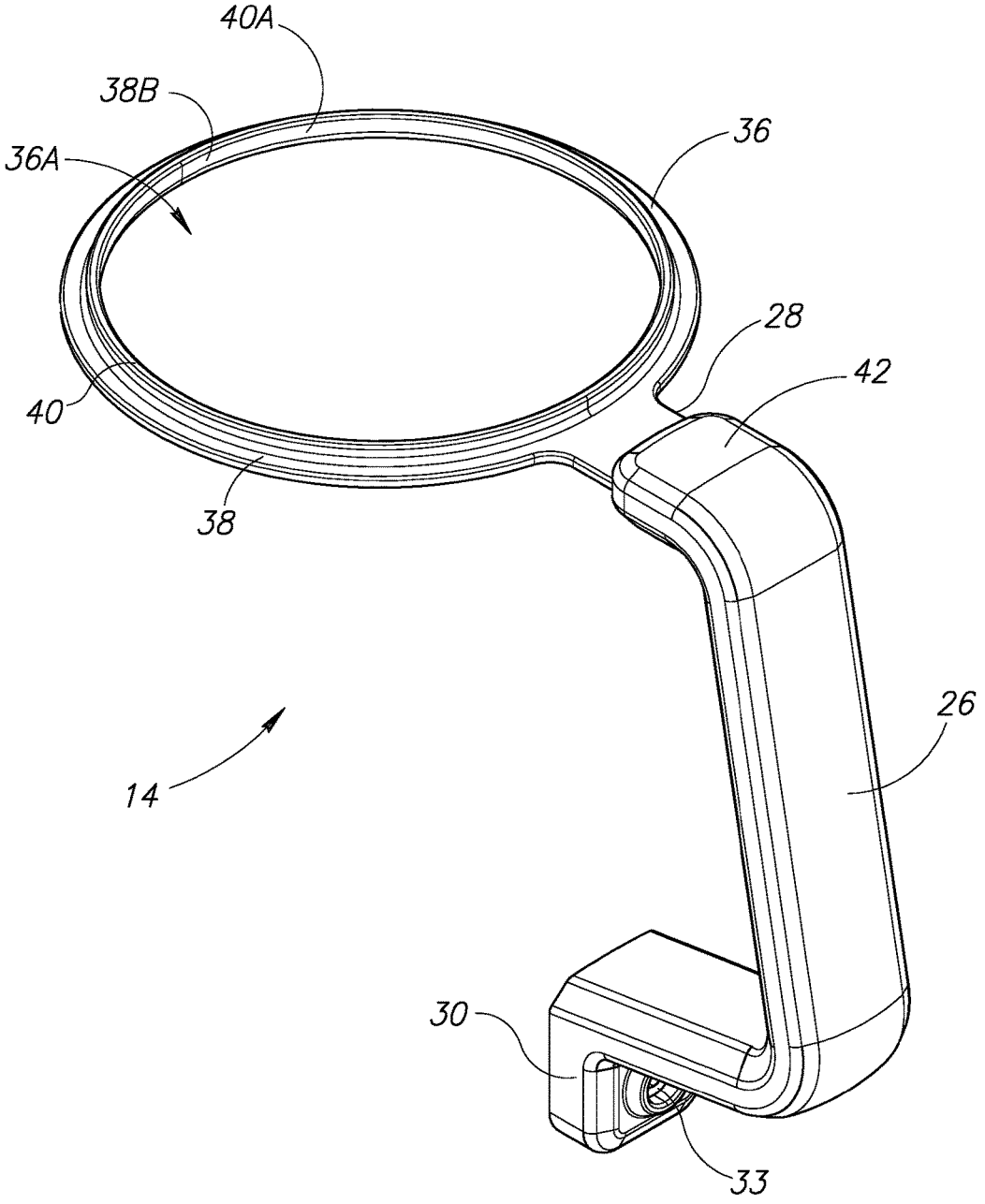
FIG. 3 illustrates a perspective view of a handle the beverage container of FIG. 1.

The handle portion 14 includes an attachment collar 36 for attaching the handle upper portion 28 to the container main body 12. The attachment collar 36 of the present embodiment has an annular shape, as shown in FIG. 3, with an opening 36A sized to snuggly receive therein the upper sidewall 24 to help secure the handle portion 14 to the container main body 12, as described below. The diameter of the opening 36A is approximately the same diameter as the outer diameter of a lower portion 24L of the upper sidewall 24, which is adjacent to the upper portion 16. The attachment collar 36 includes a base portion 38 having a lower surface 38A that abuts or is immediately adjacent to an upwardly facing ledge wall surface 39 of the upper portion 16. The base portion 38 has an upwardly projecting, inner circumferential surface 38B abutting or immediately adjacent to an outer periphery of the lower portion 24L of the upper sidewall 24. The attachment collar 36 may include an upwardly extending collar sidewall 40 which extends upward from the base portion 38 and has an inner circumferential surface 40A that abuts or is adjacent to the outer periphery of the lower portion 24L of the upper sidewall 24. The handle portion 14 may include a rigid grip upper portion 42 extending laterally toward the container main body 12 that helps to prevent the upper portion 28 from bending upwardly and thereby retains the position of the attachment collar 36 at the upper sidewall 24 and positioned at the upwardly facing surface of the upper portion 16. No second fastening member is required.

To assemble the beverage container 10, the attachment collar 36 of the handle portion 14 is first positioned over an upper portion 24U of the upper sidewall 24 and then lowered so that the upper sidewall projects through the opening 36A of the attachment collar 36. The attachment collar 36 is moved downwardly until the inner circumferential surface 38B of the base portion 38 is immediately adjacent to or abutting the outer periphery of the lower portion 24L of the upper sidewall 24 and/or the lower surface 38A of the base portion 38 is immediately adjacent to or abutting the upwardly facing surface 39 of the upper portion 16 of the container main body 12. Thereafter, the handle portion 14 is rotated as needed to align the aperture 33 of the handle lower portion 30 with the receptacle 34, and the fastening member 32 is then inserted into the receptacle 34 and rotated to threadably attach the handle lower portion 30 to the container main body 12. Attachment of the handle lower portion 30 at the receptacle 34 helps to prevent the attachment collar 36 from moving upwardly and away from the upwardly facing surface of the upper portion 16. The snug friction fit of the inner circumferential surface 38B of the attachment collar 36 against the outer circumferential surface of the lower portion 24L of the upper sidewall 24 may help to prevent lateral movement of the handle portion 14 relative to the container main body 12, and further helps to prevent upward movement of the attachment collar 36 relative to the upper portion 16. The beverage container 10 using the handle portion 14 is simpler to assemble and requires fewer parts for assembly than previously-implemented beverage containers because the beverage container 10 does not use a separate fastener to attach the handle upper portion 28 to the container main body 12.

Figure 4:
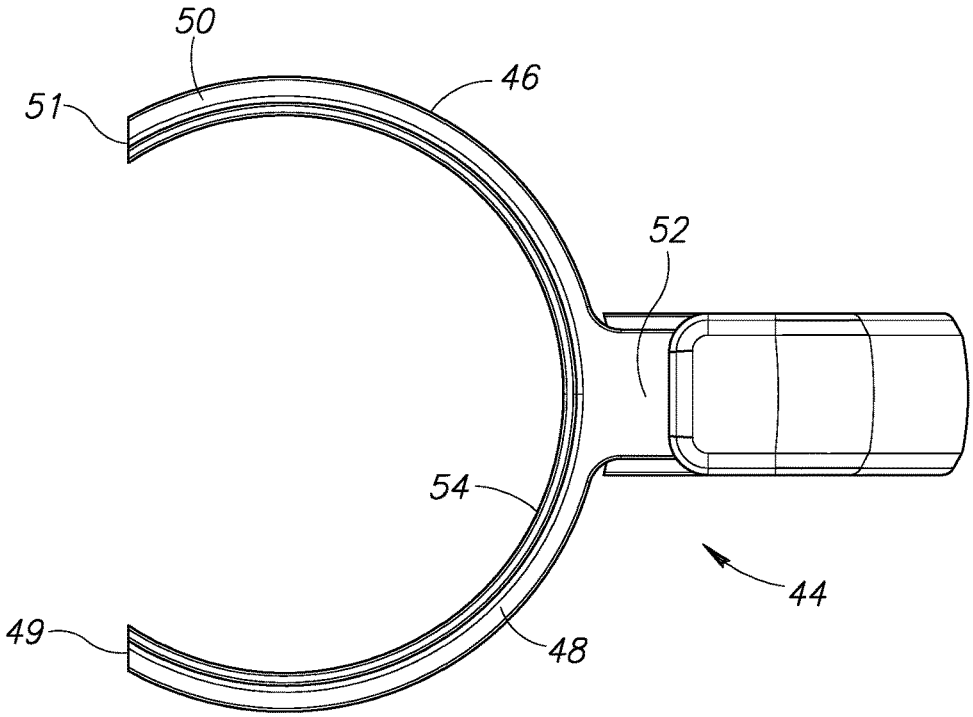
FIG. 4 illustrates a top plan view of a handle of a beverage container according to a second embodiment.

In a second embodiment the attachment collar may have a semi-circular shape that only partially surrounds an outer circumferential surface of the upper sidewall 24, as shown in FIG. 4. A handle portion 44 according to the second embodiment includes an attachment collar 46 with a first collar arm 48 and a second collar arm 50, each projecting from a handle upper portion 52. The first collar arm 48 has a curved shape extending from the handle upper portion and terminating at a first free end 49. The second collar arm 50 has a curved shape mirroring the shape of the first collar arm 48 and extending from the handle portion and terminating at a second free end 51. The first and second collar arms 48 and 50 each extend partially about a circular path with a diameter approximately the same diameter as the outer diameter of the lower portion 24L of the upper sidewall 24. The arc length of the first collar arm 48 is approximately equal to the arc length of the second collar arm 50. The attachment collar 46 has an inner surface 54 extending between the first end 49 and the second end 51 along an inner peripheral edge of the first collar arm 48 and the second collar arm 50. The inner surface 54 is sized and shaped to snuggly fit around the upper sidewall 24 of the container main body 12 to retain the handle portion 46 thereon. When the handle portion 44 is attached to the container main body 12, each of the first collar arm 48 and the second collar arm 50 extends along or abuts more than a quarter of the outer circumference of the upper sidewall 24. That is, the inner surface 54 of the attachment collar 46 contacts more than half of the outer circumferential surface of the lower portion 24L of the upper sidewall 24.

Figure 5:
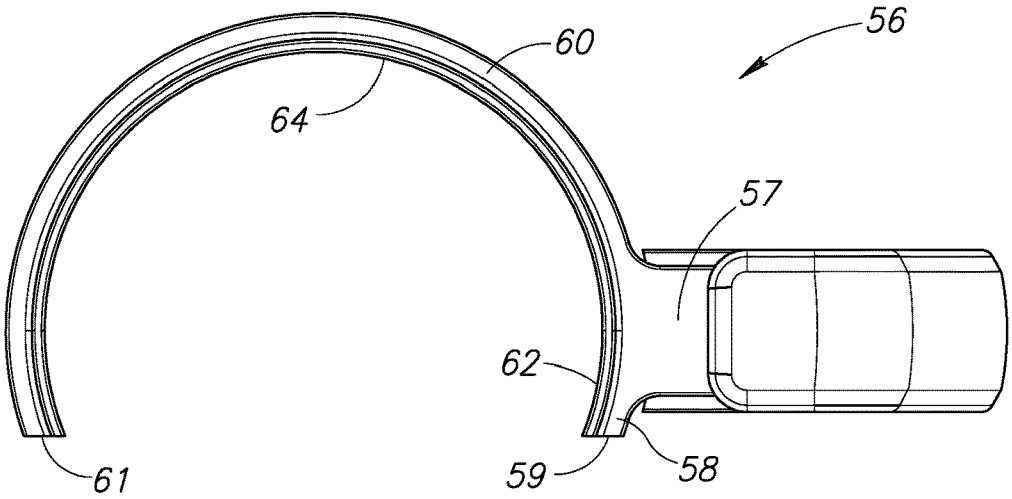
FIG. 5 illustrates a top plan view of a handle of a beverage container according to a third embodiment.

In a third embodiment shown in FIG. 5, a handle portion 56 has a first collar arm 58 that is shorter than a second collar arm 60. The first collar arm 58 has a curved shape extending from a handle upper portion 57 and terminating at a first end 59. The second collar arm 60 has a curved shape extending from the handle upper portion 57 and terminating at a second end 61; however, the arc length of the second collar arm 60 is greater than the arc length of the first collar arm 58. A first inner peripheral surface 62 of the first collar arm 58 contacts less than a quarter of the outer circumferential surface of the upper sidewall 24. A second inner peripheral surface 64 of the second collar arm 60 contacts more than half of the outer circumferential surface of the upper sidewall 24. The first inner peripheral surface 62 and second inner peripheral surface 64, in combination, are sized and shaped to snuggly fit around the upper sidewall 24 of the container main body 12 to retain the handle portion 56 thereon.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

What is claimed is:

1. A beverage container, comprising:

a beverage container body including a container lower portion having a beverage cavity and a container upper portion extending upwardly from the container lower portion, the container lower portion having a lower sidewall portion and a bottom wall located below the lower sidewall portion, the container upper portion having a container upper portion passageway in fluid communication with the beverage cavity and terminating in an upper passageway opening, the container upper portion having an exterior sidewall with an upper end exterior sidewall portion and a lower end exterior sidewall portion, the upper end exterior sidewall portion having a first size and shape and the lower end exterior sidewall portion having a second size and shape; and a handle including an attachment collar portion, a lower attachment portion and a grip portion extending between the attachment collar portion and the lower attachment portion, the attachment collar portion having an attachment collar portion opening with a fixed third size and shape, the third size and shape of the attachment collar portion opening relative to the first size and shape of the upper end exterior sidewall portion and the second size and shape of the lower end exterior sidewall portion being such that during assembly of the handle on the container body, the upper end exterior sidewall portion is positionable within the attachment collar portion opening and then the attachment collar portion is movable uninhibited toward the lower end exterior sidewall portion into a fully assembled position whereat the lower end exterior sidewall portion is positioned within the attachment collar portion opening, the lower attachment portion being attached to the lower sidewall portion of the container lower portion by a fastening member at a location above the bottom wall of the container lower portion and out of supporting engagement with the bottom wall to secure the grip portion to the container body without use of another fastening member or a clamping securement to secure the attachment collar portion to the container upper portion, the grip portion being spaced apart from and extending along the container lower portion.

2. The beverage container of claim 1, wherein when the attachment collar portion is in the fully assembled position, the lower end exterior sidewall portion restrains the attachment collar portion against lateral movement relative to the container upper portion.

3. The beverage container of claim 1, wherein when the attachment collar portion is in the fully assembled position, the lower end exterior sidewall portion fits snuggly within the attachment collar portion opening.

4. A beverage container, comprising:

a beverage container body including a container lower portion having a beverage cavity and a container upper portion extending upwardly from the container lower portion, the container lower portion having a lower sidewall portion and a bottom wall located below the lower sidewall portion, the container upper portion having a container upper portion passageway in fluid communication with the beverage cavity and terminating in an upper passageway opening, the container upper portion having an exterior sidewall with an upper end exterior sidewall portion, a lower end exterior sidewall portion, and an upwardly facing circumferentially extending wall positioned below the lower end exterior sidewall portion, the upper end exterior sidewall portion having a first size and shape and the lower end exterior sidewall portion having a second size and shape; and a handle including an attachment collar portion, a lower attachment portion and a grip portion extending between the attachment collar portion and the lower attachment portion, the attachment collar portion having an attachment collar portion opening with a non-adjustable third size and shape, the third size and shape of the attachment collar portion opening relative to the first size and shape of the upper end exterior sidewall portion and the second size and shape of the lower end exterior sidewall portion being such that during assembly of the handle on the container body, the upper end exterior sidewall portion is positionable within the attachment collar portion opening and then the attachment collar portion is movable uninhibited and directly toward the lower end exterior sidewall portion into position adjacent to the circumferentially extending wall with the attachment collar portion extending fully about the lower end exterior sidewall portion, the lower attachment portion being attached to the lower sidewall portion of the container lower portion by a fastening member at a location above the bottom wall of the container lower portion and out of supporting engagement with the bottom wall to secure the grip portion to the container body without use of another fastening member or a clamping securement to secure the attachment collar portion to the container upper portion, the grip portion being spaced apart from and extending along the container lower portion.

5. The beverage container of claim 4, wherein when the attachment collar portion is in position adjacent to the circumferentially extending wall, the lower end exterior sidewall restrains the attachment collar portion against lateral movement relative to the container upper portion.

6. The beverage container of claim 4, wherein when the attachment collar portion is in position adjacent to the circumferentially extending wall, the lower end exterior sidewall portion fits snuggly within the attachment collar portion opening.

7. A beverage container, comprising:

a beverage container body including a container lower portion having a beverage cavity and a container upper portion extending upwardly from the container lower portion, the container lower portion having a lower sidewall portion and a bottom wall located below the lower sidewall portion, the container upper portion having a container upper portion passageway in fluid communication with the beverage cavity and extending upwardly from the beverage cavity, the container upper portion having an exterior sidewall with an upper end exterior sidewall portion and a lower end exterior sidewall, the upper end exterior sidewall portion having a first size and shape and the lower end exterior sidewall portion having a second size and shape; and a handle including an upper attachment portion, a lower attachment portion and a grip portion extending between the upper attachment portion and the lower attachment portion, the upper attachment portion having an upper attachment portion opening having a fixed third size and shape, the third size and shape of the upper attachment portion opening relative to the first size and shape of the upper end exterior sidewall portion and the second size and shape of the lower end exterior sidewall portion being such that during assembly of the handle on the container body, the upper end exterior sidewall portion is positionable within the upper attachment portion opening and then the upper attachment portion is movable uninhibited toward the lower end exterior sidewall portion into a fully assembled position whereat the lower end exterior sidewall portion is positioned within the upper attachment portion opening with the upper attachment portion extending at least partially about the lower end exterior sidewall portion, the lower attachment portion being attached to the lower sidewall portion of the container lower portion at a location above the bottom wall of the container lower portion and out of supporting engagement with the bottom wall to secure the grip portion to the container body without use of a fastening member or a clamping securement to secure the upper attachment portion to the container upper portion and retain the upper attachment portion in the fully assembled position against movement therefrom during use of the beverage container, the upper attachment portion and the lower attachment portion securing the grip portion to the container body with the grip portion spaced apart from and extending along at least a portion of the container lower portion.

8. The beverage container of claim 7, wherein the upper attachment portion extends fully about the lower end exterior sidewall portion.

9. The beverage container of claim 7, wherein the lower attachment portion is securely attached to the lower sidewall of the container lower portion at the location above the bottom wall of the container lower portion by a fastening member.

10. The beverage container of claim 9, further including a receptacle attached to the lower sidewall of the container lower portion at the location above the bottom wall of the container lower portion for receiving the fastening member.

11. The beverage container of claim 7, wherein the upper attachment portion has in inner wall which extends fully about the upper attachment portion opening and fully encircles the lower end exterior sidewall portion when positioned within the upper attachment portion opening, and the inner wall being in face-to-face juxtaposition with the lower end exterior sidewall portion at all circumferential positions along the lower end exterior sidewall portion.

12. The beverage container of claim 11 wherein the upper attachment portion opening is sized to snuggly receive therein the lower end exterior sidewall portion and tightly retain the lower end exterior sidewall portion against movement toward the upper end exterior sidewall portion.

13. The beverage container of claim 7, wherein the upper attachment portion opening is sized and shaped to snuggly receive therein the lower end exterior sidewall portion.

14. The beverage container of claim 7, wherein the handle further includes an upper handle portion and the grip portion includes a rigid upper end portion extending laterally toward the container upper portion, the upper handle portion extending between the upper attachment portion and the rigid upper end portion.

15. The beverage container of claim 7, wherein the upper attachment portion has a continuous, non-adjustable collar portion defining the upper attachment portion opening with the third size and shape, the collar portion extending fully about the lower end exterior sidewall portion, and the upper attachment portion opening being sized and shaped to snuggly receive therein the lower end exterior sidewall portion.

16. A beverage container, comprising:

a beverage container body including a container lower portion having a beverage cavity and a container upper portion extending upwardly from the container lower portion, the container lower portion having a lower sidewall portion and a bottom wall located below the lower sidewall portion, the container upper portion having a container upper portion passageway in fluid communication with the beverage cavity and terminating in an upper passageway opening, the container upper portion having an exterior sidewall with an upper end exterior sidewall portion, a lower end exterior sidewall portion, and an upwardly facing ledge wall positioned below the lower end exterior sidewall portion, the upper end exterior sidewall portion having a first size and shape and the lower end exterior sidewall portion having a second size and shape; and a handle including a single-piece, continuous attachment collar portion, a lower attachment portion and a grip portion extending between the attachment collar portion and the lower attachment portion, the attachment collar portion having an attachment collar portion opening with a fixed third size and shape, the third size and shape of the attachment collar portion opening relative to the first size and shape of the upper end exterior sidewall portion and the second size and shape of the lower end exterior sidewall portion being such that during assembly of the handle on the container body, the upper end exterior sidewall portion is positionable within the attachment collar portion opening and then the attachment collar portion is movable uninhibited and directly toward the lower end exterior sidewall portion into position adjacent to the ledge wall whereat the lower end exterior sidewall portion fits snuggly within the attachment collar portion opening with the attachment collar portion extending fully about the lower end exterior sidewall portion, the lower attachment portion being attached to the lower sidewall portion of the container lower portion by a first fastening member at a location above the bottom wall of the container lower portion and out of supporting engagement with the bottom wall to secure the grip portion to the container body without use of a second fastening member or a clamping securement to secure the attachment collar portion to the container upper portion and retain the attachment collar portion in position adjacent to the ledge wall and thereby prevent the attachment collar portion moving upward away from the ledge wall and laterally relative to the container upper portion during use of the beverage container, the grip portion being spaced apart from and extending along the container lower portion.

17. The beverage container of claim 16, wherein the upper end exterior sidewall portion has an upper end terminating at an upper end of the container upper portion passageway opening.

18. The beverage container of claim 16, wherein the ledge wall is a continuous wall extending fully about the lower end exterior sidewall portion and is in supporting engagement with the attachment collar portion.

19. The beverage container of claim 18, wherein the attachment collar portion is in parallel relation to the ledge wall.

20. The beverage container of claim 16, wherein the attachment collar portion opening is defined by an upwardly extending inner wall portion of the attachment collar portion sized and shaped to be immediately adjacent to and engage the lower end exterior sidewall portion when the attachment collar is in position adjacent to the ledge wall.

21. The beverage container of claim 16, wherein the lower end exterior sidewall portion has a smooth wall with the same size and shape along the entire lower end exterior sidewall portion.

22. The beverage container of claim 16, wherein the lower end exterior sidewall portion has an upper end portion and the upper end exterior sidewall portion has a lower end portion with the same size and shape as the upper end portion of the lower end exterior sidewall portion, the lower end portion of the upper end exterior sidewall portion being located adjacent to the upper end portion of the lower end exterior sidewall portion, and the lower end portion of the upper end exterior sidewall portion and the upper end portion of the lower end exterior sidewall portion defining together a smooth wall portion of the exterior sidewall of the container upper portion.

23. The beverage container of claim 16, wherein the upper end exterior sidewall portion is without retention features configured to prevent movement of the attachment collar portion from the lower end exterior sidewall portion along the container upper portion toward the upper end exterior sidewall portion during use of the beverage container.

24. The beverage container of claim 16, wherein the handle includes an upper handle portion and the grip portion includes a rigid upper end portion, the upper handle portion extending between the attachment collar portion and the rigid upper end portion of the grip portion, the rigidity of the rigid upper end portion of the grip portion inhibiting upwardly bending of the upper handle portion to retain the position of the attachment collar portion relative to the container upper portion.

25. The beverage container of claim 24, wherein the rigid upper end portion of the grip portion projects laterally toward the container upper portion.

26. The beverage container of claim 25, wherein the upper handle portion projects laterally between the attachment collar portion and the rigid upper end portion of the grip portion.

27. The beverage container of claim 16, wherein the container upper portion extends upwardly above the attachment collar portion through the attachment collar portion opening, the attachment collar portion includes a radially outwardly projecting collar portion extending fully around the container upper portion, and the handle includes an upper handle portion extending between the attachment collar portion and the grip portion, the outwardly projecting collar portion and the upper handle portion being in coplanar arrangement.

28. The beverage container of claim 27, wherein the attachment collar portion includes a collar inward sidewall portion extending fully around the container upper portion and defining the attachment collar portion opening, the collar inward sidewall portion projecting upwardly from the radially outwardly projecting collar portion, and the lower end exterior sidewall portion has an upwardly projecting outward sidewall positioned within the attachment collar portion opening in face-to-face juxtaposition with the collar inward sidewall portion.

* * * * *